US006332798B1

(12) United States Patent
Farooq

(10) Patent No.: US 6,332,798 B1
(45) Date of Patent: Dec. 25, 2001

(54) RJ-45 JACK MODULE WITH SIMULTANEOUS PLUG RELEASE

(75) Inventor: Rizwan M. Farooq, Santa Clara, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/691,914

(22) Filed: Oct. 20, 2000

(51) Int. Cl.[7] ..... H01R 16/635
(52) U.S. Cl. ..... 439/352; 439/344
(58) Field of Search ..... 439/344, 352

(56) References Cited

U.S. PATENT DOCUMENTS 6,174,190 * 1/2001 Tharp et al. ..... 439/352
6,254,418 * 7/2001 Tharp et al. ..... 439/352

* cited by examiner

*Primary Examiner*—Gary Paumen
(74) *Attorney, Agent, or Firm*—Manelli Denison & Selter PLLC

(57) ABSTRACT

A device is provided for receiving RJ-45 plugs in corresponding jacks. Each RJ-45 plug has a lever arm movable from a locked position, locking the plug to a corresponding jack, to a released position permitting the plug to be removed from the corresponding jack. The device includes a body having a plurality of jacks therein. Each jack is constructed and arranged to receive at least a portion of a RJ-45 plug therein. A plug releasing mechanism is mounted with respect to the body and is constructed and arranged such that when at least two plugs are disposed in the locked position in corresponding jacks, movement of the plug releasing mechanism to an actuating position engages the lever arm of each of the plugs, moving the lever arms to the released position generally simultaneously.

10 Claims, 1 Drawing Sheet

RJ-45 JACK MODULE WITH SIMULTANEOUS PLUG RELEASE

BACKGROUND OF THE INVENTION

1. Field of the Invention

The present invention relates to jack modules which receive multiple RJ-45 plugs for testing network switches.

2. Background Art

With reference to FIG. 1, in testing network switches, multiple RJ-45 plugs 10 must be plugged into and removed from a corresponding jack 12 of a module 14 many times. Removing the plugs 10 becomes tedious and tiresome since each plug 10 must be removed individually from the corresponding jack 12 by fist depressing the conventional resilient lever arm 16 and then pulling the plug 10 from the corresponding jack 14.

SUMMARY OF THE INVENTION

There is a need for an arrangement that eases the removal of RJ-45 plugs by enabling the plugs to be removed generally simultaneously from jacks of a module.

This and other needs are attained by the present invention, where a device is provided for receiving RJ-45 plugs in respective jacks. Each RJ-45 plug has a lever arm movable from a locked position, locking the plug to a corresponding jack, to a released position permitting the plug to be removed from the corresponding jack. The device includes a body having a plurality of jacks therein. Each jack is constructed and arranged to receive at least a portion of a RJ-45 plug therein. A plug releasing mechanism is mounted with respect to the body and is constructed and arranged such that when at least two plugs are disposed in the locked position in corresponding jacks, movement of the plug releasing mechanism to an actuating position engages the lever arm of each of the plugs, moving the lever arms to the released position generally simultaneously.

In accordance with another aspect of the invention, a method of removing a plurality of RJ-45 plugs from corresponding jacks of a module is provided. Each RJ-45 plug has a lever arm movable from a locked position locking the plug to a corresponding jack and a released position permitting the plug to be removed from the corresponding jack. The method provides a plug releasing mechanism operatively coupled with the module. A plug release mechanism is provided to engage the lever arm of each of the plugs generally simultaneously thereby moving the lever arms to the released position generally simultaneously. The plugs are then removed from the module.

Additional advantages and novel features of the invention will be set forth in part in the description which follows and in part will become apparent to those skilled in the art upon examination of the following or may be learned by practice of the invention. The advantages of the present invention may be realized and attained by means of instrumentalities and combinations particularly pointed in the appended claims.

BRIEF DESCRIPTION OF THE DRAWINGS

Reference is made to the attached drawings, wherein elements having the same reference numeral designations represent like elements throughout and wherein.

BEST MODE FOR CARRYING OUT THE INVENTION

Figure 1:
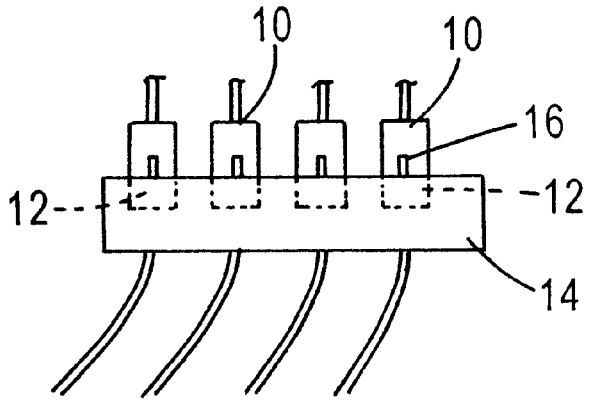
FIG. 1 is a plan view of a conventional module having a plurality of jacks, each jack receiving a corresponding RJ-45 plug.
Figure 2:
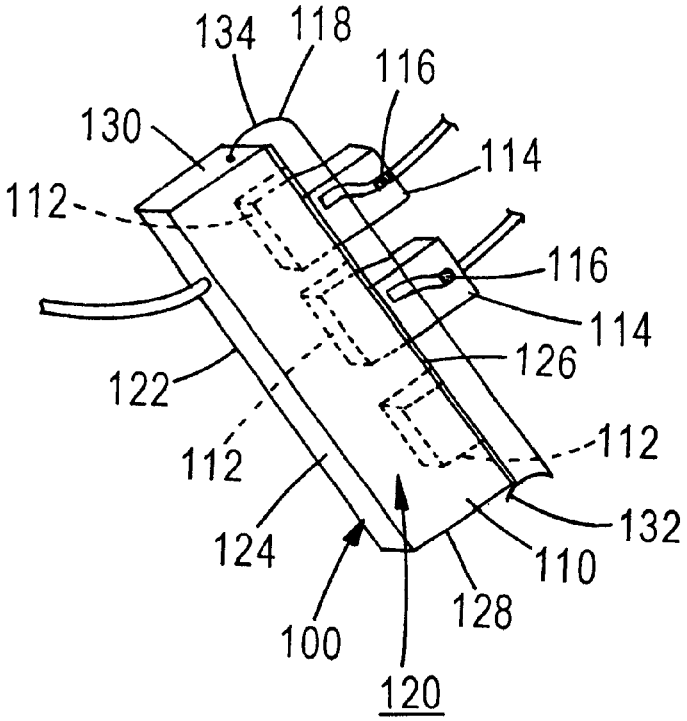
FIG. 2 is a perspective view of a module for receiving a plurality of RJ-45 plugs with the module having a plug release mechanism provided in accordance with the principles of the present invention.

With reference to FIG. 2, a module or device, generally indicated at 100, is shown for receiving RJ45 plugs in accordance with the principles of the present invention. The device 100 includes a body 110 having a plurality of jacks 112 therein. Each jack 112 is constructed and arranged to receive at least a portion of a RJ-45 plug 114 therein. In the illustrated embodiment, the plug 114 is a conventional RJ-45 plug having a conventional resilient lever arm 116 movable from a locked position locking the plug to a corresponding jack and, a released position permitting the plug 114 to be removed from the corresponding jack 112 in the known manner.

The device 100 includes a plug releasing mechanism 118 mounted on the body 110 and being constructed and arranged such that when at least two plugs 114 are disposed in the locked position in two corresponding jacks 112, movement of the plug releasing mechanism 118 to an actuating position engages the lever arm 116 of each of the plugs 114 generally simultaneously moving the lever arms 116 to the released position generally simultaneously.

The body 110 has a top 120, a bottom 122, opposing sides 124 and 126, and opposing first and second ends, 128 and 130, respectively. In the illustrated embodiment, the plug releasing mechanism 118 comprises a lever having a first end 132 and a second end 134. The first end 132 of the lever 118 is pivotally coupled to the first end 128 of the body 110 and the second end 134 of the lever is pivotally coupled to the second end 130 of the body 110. The lever 118 is preferably a wire or thin plastic member extending from side 126 (which includes the jacks 112) a length sufficient to contact the lever arms 116 of the plugs 114 when the plugs are received in corresponding jacks 112. The lever is constructed and arranged to be manually engaged to be pivoted to the actuating position. When installing the plugs 114 into the jacks, the lever 118 can be pivoted upwardly out of the way of the incoming plug.

Thus, when a plurality of plugs 114 are locked in corresponding jacks 112 of a module 100, a single movement of the lever 118 engages each of the lever arms of the plugs to move the lever arms to a released position, eliminating the need to individually release each lever arm from the corresponding jack 112. Thereafter each plug 114 can be removed from the corresponding jack 112.

While this invention has been described with what is presently considered to be the most practical preferred embodiment, it is to be understood that the invention is not limited to the disclosed embodiments, but, on the contrary, is intended to cover various modifications and equivalent arrangements included within the spirit and scope of the appended claims.

What is claimed is:

1. A device for receiving RJ plugs, each RJ plug having a lever arm movable from a locked position to a released position the device comprising:

a body having a plurality of jacks therein, each jack being constructed and arranged to receive at least a portion of an RJ plug therein, and a plug releasing mechanism mounted with respect to said body and being constructed and arranged such that when at least two of the RJ plugs are disposed in the locked position in two corresponding said jacks, movement of said plug releasing mechanism to an actuating position engages the lever arm of each of said plugs, moving said lever arms to said released position generally simultaneously.

2. The device of claim 1, wherein said body has a top, a bottom, opposing sides, one of the sides including the jacks, and opposing first and second ends, said plug releasing mechanism comprising a lever having first and second ends, the first end of said lever being pivotally coupled to said first end of said body and said second end of said lever being pivotally coupled to said second end of said body.

3. The device of claim 2, wherein said lever extends from said one side a length sufficient to contact the lever arms of the plugs when received in the corresponding jacks.

4. The device of claim 3, wherein said lever comprises a wire.

5. The device of claim 2, wherein said lever is constructed and arranged to be manually engaged to be pivoted to said actuating position.

6. The device of claim 1, wherein said jacks are constructed and arranged to receive RJ-45 plugs.

7. A method of removing a plurality of RJ plugs from corresponding jacks of a module, each RJ plug having a lever arm movable from a locked position locking the plug to a corresponding jack and a released position permitting the plug to be removed from the corresponding jack, the method including providing a plug releasing mechanism operatively coupled with said module, moving the plug release mechanism to engage the lever arm of each of said plugs generally simultaneously thereby moving said lever arms to said released position generally simultaneously, and removing the plugs from the module.

8. The method of claim 7, wherein the step of providing the plug releasing mechanism includes pivotally coupling the plug release mechanism with respect to said module.

9. The method of claim 8, wherein the moving step includes manually pivoting the plug release mechanism with respect to said module.

10. The method of claim 7, wherein the step of providing the plug releasing mechanism includes pivotally coupling a wire to opposing ends of said module.

* * * * *